US010047560B2

(12) United States Patent
Roth

(10) Patent No.: US 10,047,560 B2
(45) Date of Patent: Aug. 14, 2018

(54) GUIDED TYPE FALL ARRESTER—FORCE CONTROL

(71) Applicant: Honeywell International Inc., Morris Plains, NJ (US)

(72) Inventor: Markus Roth, Konradsreuth (DE)

(73) Assignee: Honeywell International Inc., Morris Plains, NJ (US)

( * ) Notice: Subject to any disclaimer, the term of this patent is extended or adjusted under 35 U.S.C. 154(b) by 0 days.

(21) Appl. No.: 15/313,450

(22) PCT Filed: May 14, 2015

(86) PCT No.: PCT/US2015/030697

§ 371 (c)(1),
(2) Date: Nov. 22, 2016

(87) PCT Pub. No.: WO2015/183564

PCT Pub. Date: Dec. 3, 2015

(65) Prior Publication Data

US 2017/0183910 A1 Jun. 29, 2017

Related U.S. Application Data

(60) Provisional application No. 62/004,816, filed on May 29, 2014.

(51) Int. Cl.
*A62B 35/00* (2006.01)
*E06C 7/18* (2006.01)

(52) U.S. Cl.
CPC ..... *E06C 7/187* (2013.01); *A62B 35/005* (2013.01); *A62B 35/0062* (2013.01); *A62B 35/0081* (2013.01)

(58) Field of Classification Search
CPC .... A62B 1/00; A62B 1/02; A62B 1/14; A62B 35/00; A62B 35/0062; A62B 35/0093; E06C 7/18; E06C 7/186; E06C 7/187
See application file for complete search history.

(56) References Cited

U.S. PATENT DOCUMENTS 2,616,609 A * 11/1952 Herod ..... E06C 7/187 182/8
3,348,632 A * 10/1967 Swager ..... A62B 35/04 182/230

(Continued)

FOREIGN PATENT DOCUMENTS

| | | | |
|---|---|---|---|
| DE | 202005011338 | U1 | 12/2006 |
| EP | 0168021 | A1 | 1/1986 |
| WO | 2008046446 | A1 | 4/2008 |

OTHER PUBLICATIONS

International Search Report and Written Opinion dated Jul. 31, 2015.

*Primary Examiner* — Daniel P Cahn
(74) *Attorney, Agent, or Firm* — Wood, Phillips, Katz, Clark & Mortimer

(57) ABSTRACT

A fall arrester is provided and includes a pawl and connecting element that are configured such that the pawl and connecting element rotate in a common direction to move the pawl to an engaging position in response to a first predetermined force applied to the connecting element in a first direction, and to allow the pawl to rotate away from the connecting element as the pawl moves to the engaging position in response to a second predetermined force applied to the connecting element in a second direction that is different than the first direction.

12 Claims, 6 Drawing Sheets

(56) References Cited

U.S. PATENT DOCUMENTS 3,523,591 A * 8/1970 Fountain ..... A63B 27/04 182/8
3,852,943 A * 12/1974 Healy ..... A62L 31/14 16/257
4,071,926 A * 2/1978 Sweet ..... A62B 1/14 182/8
4,085,818 A * 4/1978 Swager ..... E06C 7/08 182/137
4,111,280 A * 9/1978 Devine ..... E06C 7/187 182/8
4,193,475 A * 3/1980 Sweet ..... A62B 35/0062 182/8
4,269,284 A * 5/1981 Swager ..... E06C 7/187 182/8
4,499,966 A * 2/1985 Milne ..... A62B 35/0062 182/3
4,560,029 A * 12/1985 Dalmaso ..... A62B 35/04 182/112
4,572,329 A * 2/1986 Kleveborn ..... A63B 27/04 182/135
4,657,110 A * 4/1987 Wolner ..... A62B 35/04 182/192
5,238,084 A * 8/1993 Swager ..... E06C 7/187 182/193
5,265,696 A * 11/1993 Casebolt ..... A62B 1/14 182/192
6,161,647 A * 12/2000 Braden ..... A62B 1/14 182/5
6,457,556 B1 * 10/2002 Skade ..... A62B 35/04 182/18
6,725,969 B1 * 4/2004 Meister ..... A62B 35/0081 182/3
6,729,436 B1 * 5/2004 Yeh ..... A62B 35/0056 182/3
6,837,337 B2 * 1/2005 Thomas ..... A62B 1/14 182/192
8,056,676 B2 * 11/2011 Argoud ..... A62B 1/14 182/239
8,550,225 B2 * 10/2013 Blomberg ..... A62B 35/04 188/371
8,584,797 B2 11/2013 Krauss
D710,678 S * 8/2014 Miller ..... D8/356
8,919,498 B2 * 12/2014 Maurer ..... A63B 27/04 182/134
9,168,402 B2 * 10/2015 Casebolt ..... A62B 35/0081
9,636,528 B2 * 5/2017 Casebolt ..... A62B 35/0037
9,802,068 B2 * 10/2017 Hermes ..... A62B 35/0087
2006/0283662 A1 * 12/2006 Martin ..... A62B 1/14 182/8
2008/0230311 A1 * 9/2008 Fusco ..... A62B 35/0062 182/37
2010/0012424 A1 * 1/2010 Krauss ..... A62B 1/14 182/3
2010/0252645 A1 * 10/2010 Maurer ..... B66B 7/022 238/123
2014/0020983 A1 * 1/2014 Casebolt ..... A62B 1/14 182/241
2015/0114752 A1 * 4/2015 Bornack ..... E06C 7/186 182/5
2015/0129357 A1 * 5/2015 Roth ..... A62B 35/0093 182/5
2017/0183910 A1 * 6/2017 Roth ..... E06C 7/187

* cited by examiner

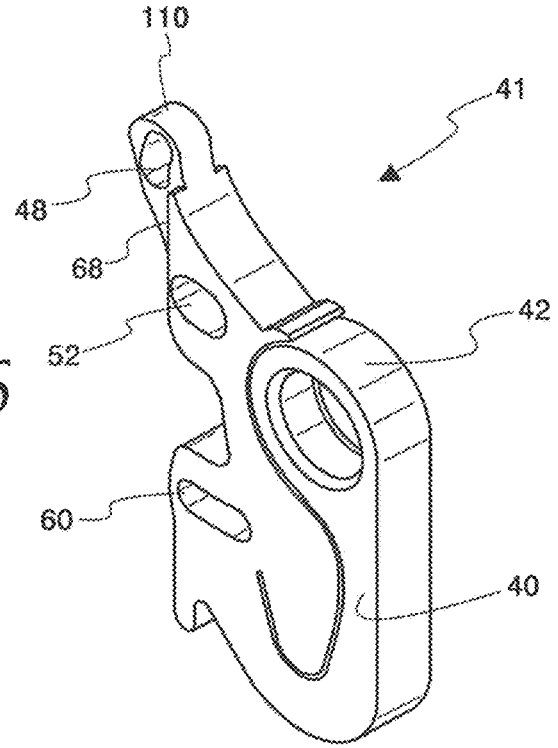
Fig. 6
Fig. 7
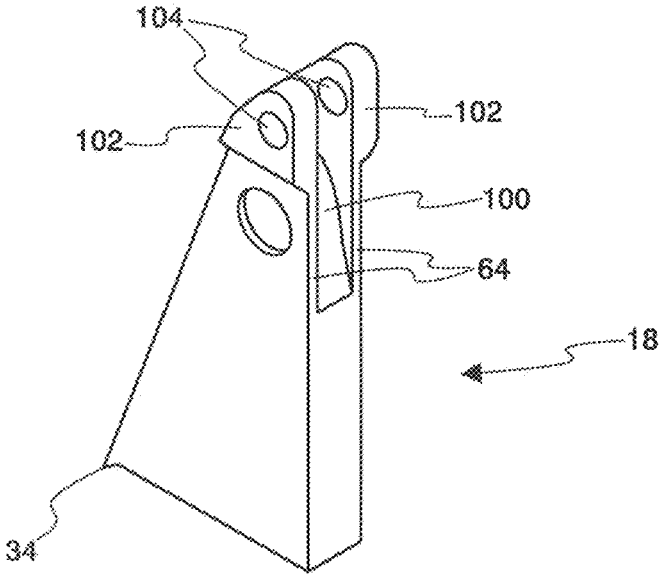

GUIDED TYPE FALL ARRESTER—FORCE CONTROL

CROSS-REFERENCE TO RELATED APPLICATIONS

This application claims priority of Provisional Ser. No. 62/004,816, filed May 29, 2014, and Appln. No. PCT/US15/30697, filed May 14, 2015, the disclosures of which are hereby incorporated by reference in their entirety.

FEDERALLY SPONSORED RESEARCH OR DEVELOPMENT

Not Applicable.

MICROFICHE/COPYRIGHT REFERENCE

Not Applicable.

FIELD

This disclosure relates to fall arresters which are part of a climbing protection system for preventing a user of a ladder, a platform or the like from falling.

BACKGROUND

Fall arresters are known to be movable along a guide rail of a climbing protection system and to have a rotatably mounted pawl which, in the event of a fall, engages against catching stops in the guide rail, whereby the fall arrester is stopped in the guide rail to arrest a user from falling further. A connecting element of the fall arrester transmits force to the pawl from the user that is secured to the connecting element by a lanyard or other suitable attaching device. The connecting element can be formed as a deformable damping element, such as shown in PCT/EP2006/067469. While such fall arresters work well for their intended purpose, there is always room for improvement.

One issue with at least some current commercially available fall arresters is that they can fail to arrest a fall under certain conditions. More specifically, at least some current commercially available fall arresters can fail to properly arrest the fall of a user when the user falls in a direction that doesn't actuate the pawl of the fall arrester into a position to engage the stops in the guide rail, such as can happen when falling from a squatted position or while leaning towards the fall arrester such as when a user becomes unconscious or dizzy.

SUMMARY

In accordance with one feature of this disclosure, a fall arrester is provided for use in a climbing protection system to protect a user of a ladder, a platform or the like from falls wherein the fall arrester is adapted to be used with, and to be movable along, a guide rail having catching stops engageable by the fall arrester in response to a fall by the user. The fall arrester includes a body configured to be movable along a guide rail, a pawl including a pawl tooth, the pawl mounted to the body for movement relative to the body between an engaging position wherein the pawl tooth will engage a catching stop in the guide rail and a disengaged position wherein the pawl tooth will not engage the catching stops in the guide rail. The fall arrester further includes a connecting element operably connected to the pawl and configured to transmit force to the pawl from a user attached to the connecting element. The pawl and the connecting element are operably connected to each other such that: (a) the pawl and the connecting element rotate in a common direction as the pawl moves from the disengaged position to the engaged position in response to a first predetermined force applied to the connecting element in a first direction, and (b) the pawl rotates away from the connecting element as the pawl moves from the disengaged position to the engaging position in response to a second predetermined force applied to the connecting element in a second direction that is different than the first direction.

As one feature, the pawl is mounted to the body to rotate about a first axis between the disengaged and engaging positions.

In one feature, the connecting element rotates about the first axis in the same direction as the pawl in response to the first predetermined force being applied to the connecting element in the first direction.

According to one feature, the connecting element is mounted to rotate about a second axis spaced from the first axis.

As one feature, the first and second axes are parallel to each other.

According to one feature, the first axis is fixed relative to the body.

In one feature, the second axis is movable relative to the body.

As one feature, the connecting element rotates about the second axis in a direction opposite to the rotation of the pawl about the first axis in response to the second predetermined force being applied to the connecting element in the second direction.

In one feature, the second axis moves with the pawl as the pawl rotates about the first axis.

According to one feature, the pawl is pre-loaded by a spring toward the disengaged position.

In one feature, the spring is engaged against the connecting element and the pre-load is transferred to the pawl by engagement of the connecting element against the pawl.

As one feature, the connecting element and the pawl are pre-loaded against each other.

According to one feature, the pre-load is overcome in response to the second predetermined force applied to the connecting element in the second direction.

As one feature, the pawl is mounted to the body to rotate about a first axis between the disengaged and the engaging positions, the connecting element is mounted to rotate about a second axis spaced from the first axis, and the pawl rotates about the first axis away from the connecting element in response to the second predetermined force being applied to the connecting element in the second direction.

In one feature, the second axis is movable relative to the body and moves with the pawl as the pawl rotates about the first axis.

According to one feature, the connecting element is formed as a damping element which deforms upon the application of the predetermined force.

In one feature, the connecting element is mounted to translate relative to the second axis in addition to rotating about the second axis.

Other features and advantages will become apparent from a review of the entire specification, including the appended claims and drawings.

BRIEF DESCRIPTION OF THE DRAWINGS

FIG. 6 is an isometric view from above showing a connecting element of the fall arrester of FIGS. 1-5; and FIG. 7 is an isometric view from above of a pawl of the fall arrester mechanism of FIGS. 1-5.

DETAILED DESCRIPTION

Figure 1:
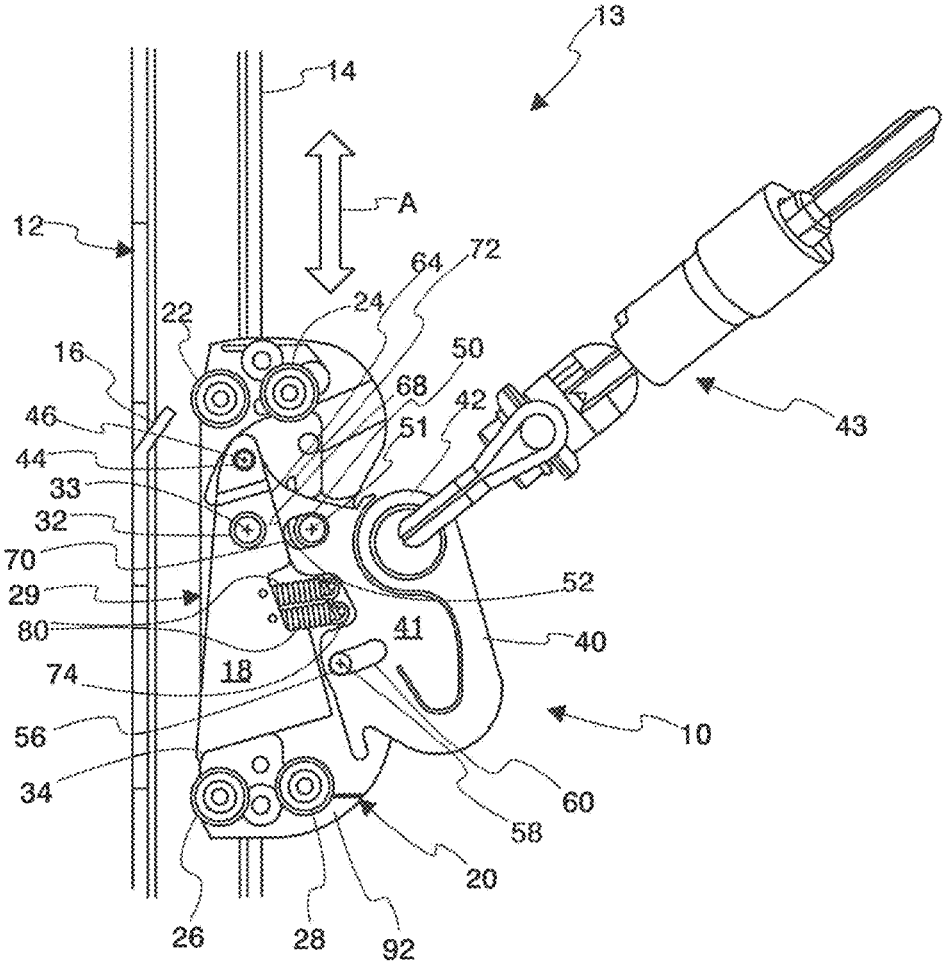
FIGS. 1-3 are side elevation views showing a fall arrester according to this disclosure as a climbing protection system as inserted into a guide rail of the climbing protection system, with each of the Figs. showing the fall arrester in a different operational states and with a portion of a body of the fall arrester and a portion of the guide rail not shown for purposes of illustration.

According to FIG. 1, a fall arrester 10 is guided in a guide rail 12 of a climbing protection system indicated generally at 13. The guide rail 12 is normally arranged vertically. The illustrated guide rail has the C-profile (C shaped cross section) known from European Patent No. EP 0168021 A1 which is open towards the front, i.e. towards the user, wherein the opening edges (only one shown in FIG. 1) of the C-profile serve as a guide flange 14. Catching stops 16 projecting into the inside of the guide rail 12 are pressed out in the rear of the guide rail.

For ease of description, the figures illustrating the fall arrester 10 show embodiments in the typical orientation that the fall arrester 10 would have when employed by a user in a climbing protection system 13, and terms such as upper, lower, horizontal, etc., are used with reference to this orientation. It will be understood, however, that the fall arrester 10 may be manufactured, stored, transported, used, and sold in an orientation other than the orientation described.

The fall arrester 10 has an elongate body 20 extending in the elongate length direction of the guide rail 12 (typically vertical) with a pawl 18 rotatably mounted therein. Two pairs of rollers 22, 24 are provided at the front end or top of the body 20. The inner pair of rollers 22 runs on the inside of the guide flange 14, while the outer pair of rollers 24 runs on the outside of the guide flange 14. The rollers 22, 24 are mounted on journal bearings which are fastened rigidly to the body 20. The inner rollers 22 remain at a distance from the outer rollers 24 that is somewhat greater than the material thickness of the guide flange 14. Two similar pairs of rollers 26, 28 are provided at the rear end or bottom of the body 20, wherein the inner pair of rollers 26 again runs on the inside of the guide flange 14, while the outer pair of rollers 28 runs on the outside of the guide flange 14.

Figure 2:
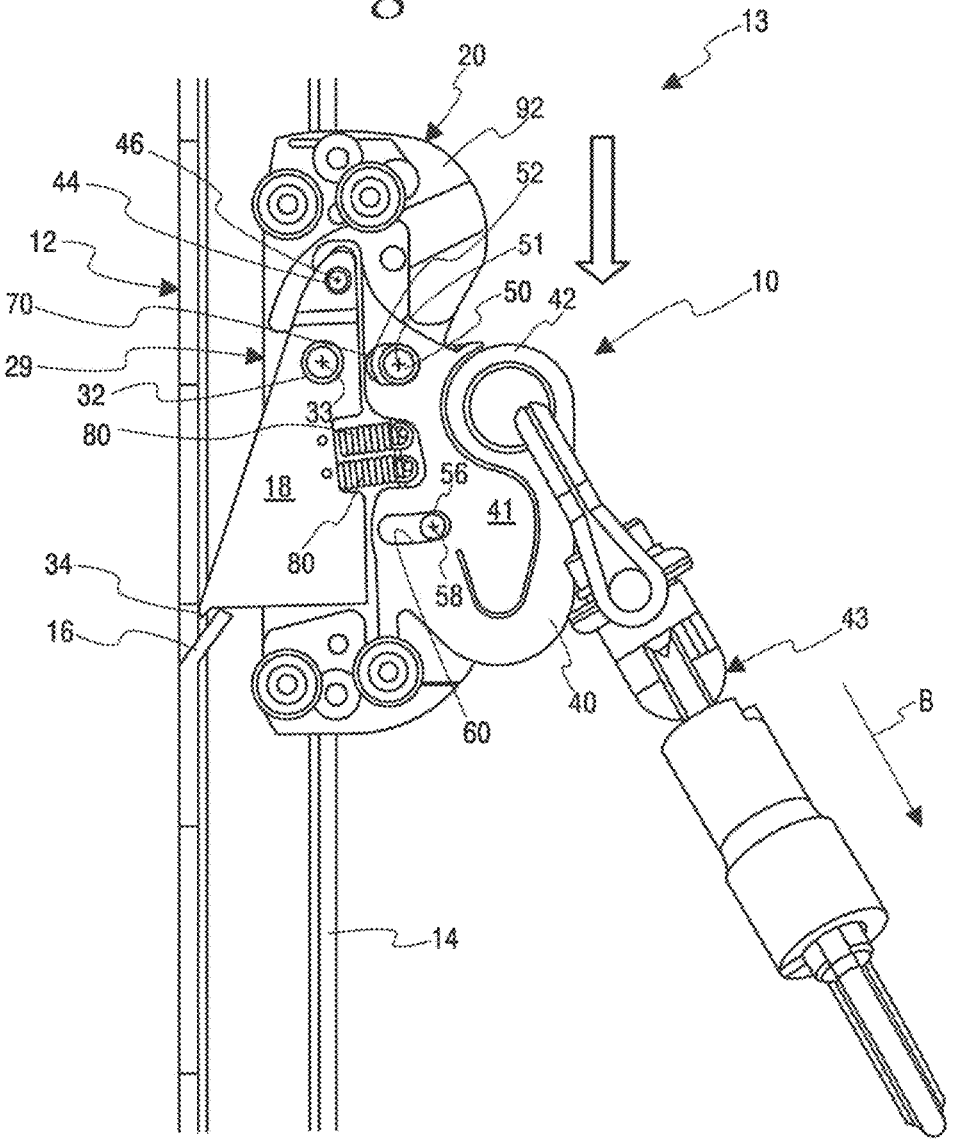
Figure 3:
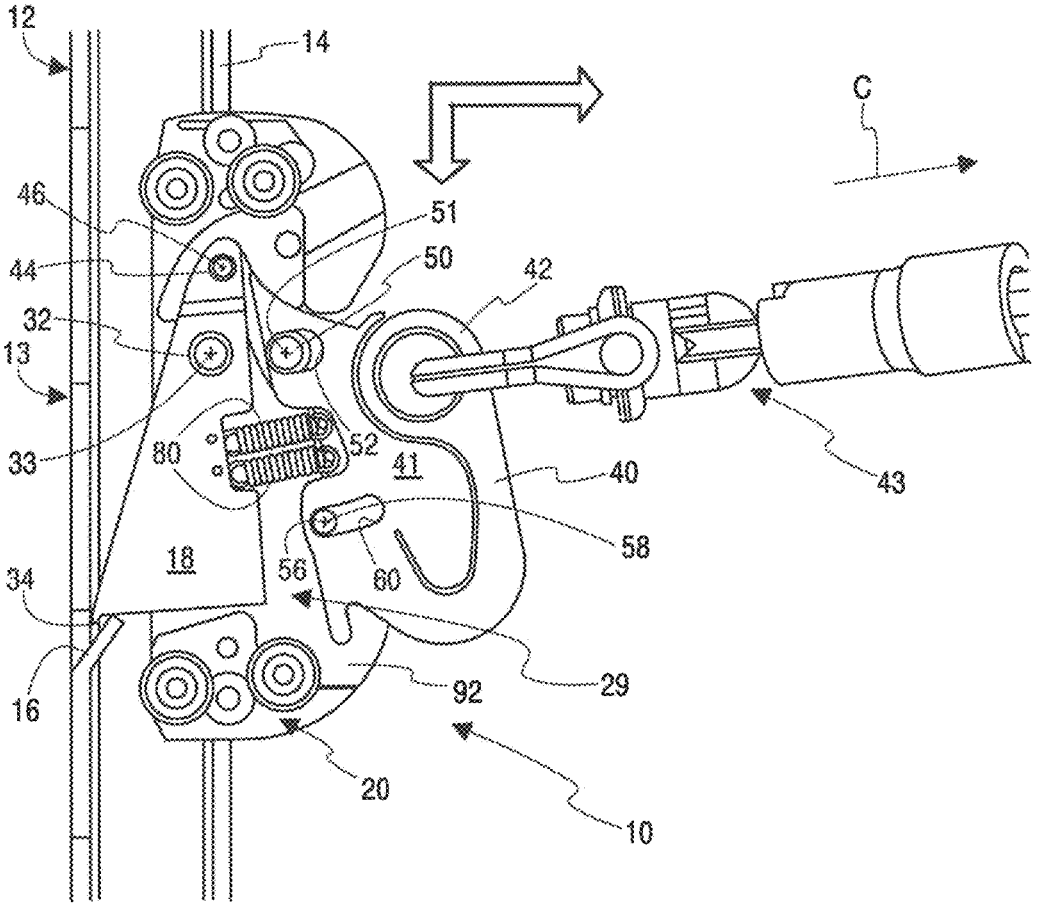
Figure 4:
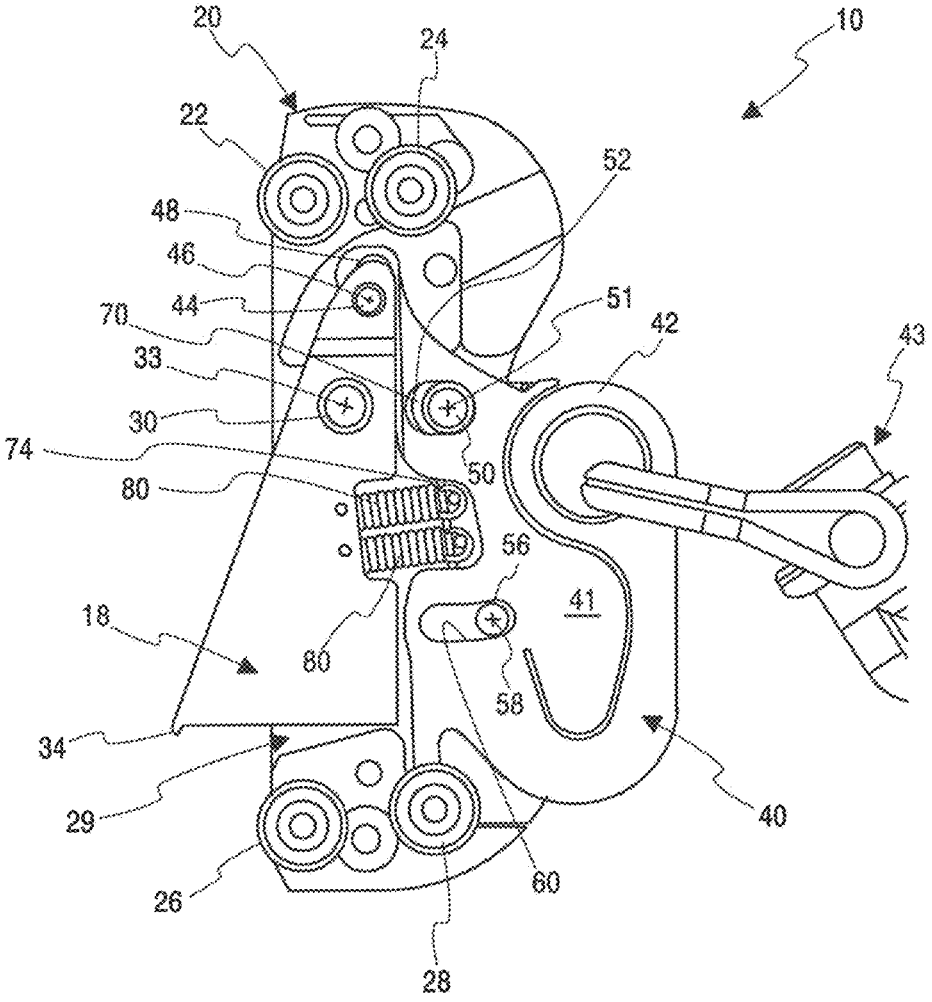
FIG. 4 is an enlarged view of the fall arrester of FIGS. 1-3 again with the same portion of the body not shown for purposes of illustration, with FIG. 4 showing the fall arrester in the same operational state as FIG. 2.
Figure 5:
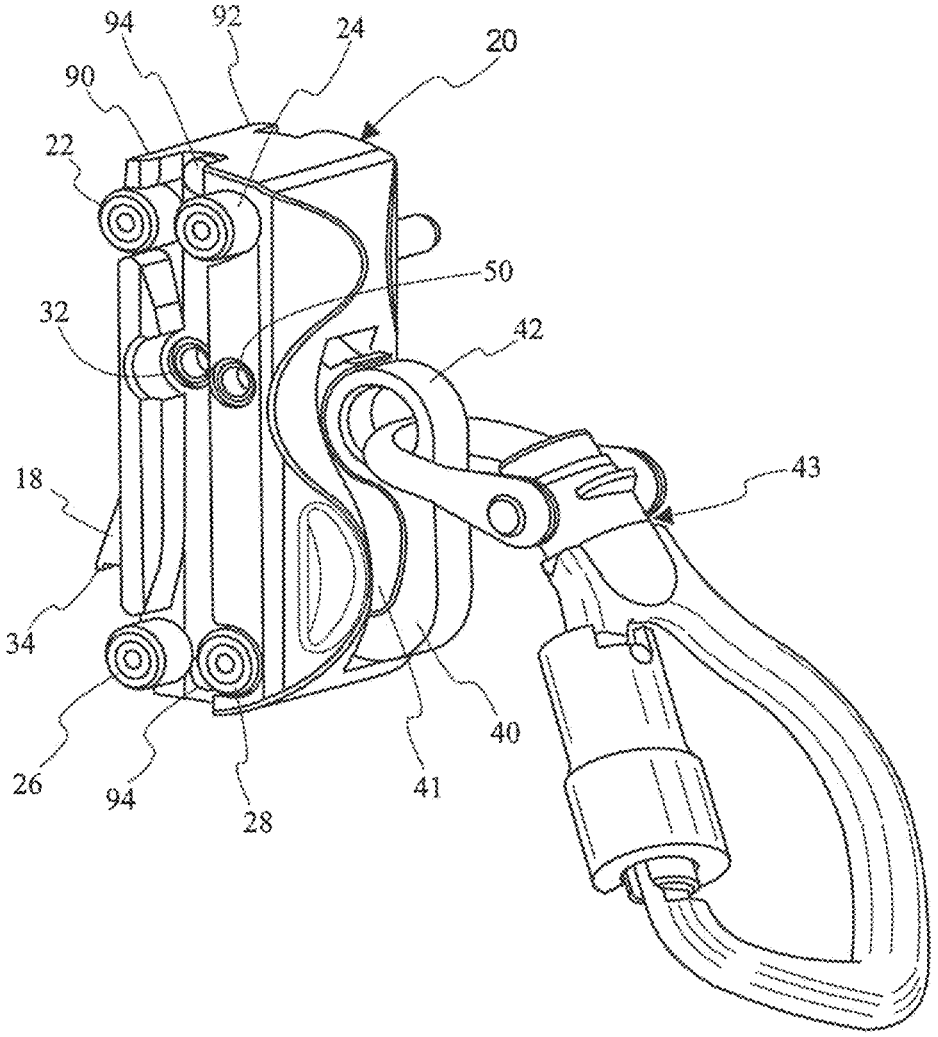
FIG. 5 is an enlarged isometric view of the fall arrester of FIGS. 1-4 and showing the portion of the body that was not shown in FIGS. 1-4.

It should be appreciated that the rollers 22, 24, 26, 28 serve to rollingly guide the fall arrester 10 up and down along the length of the guide rail 12 while bearing a portion or all of a user's weight (as shown by arrow "A" in FIG. 1), while also maintaining the fall arrester 10 within the guide rail 12 in the event of a user falling and the fall arrester engaging one of the catching stops 16 of the guide rail 12 to arrest the fall of the user (as shown in FIGS. 2 and 3). It should also be understood that this disclosure contemplates other structures that can perform the above-described function of the rollers 22, 24, 26, 28, including, but not limited to, other arrangements of rollers and/or other friction reducing components. It should further be understood that a fall arrester 10 according to this disclosure may find use with other configurations of guide rails and accordingly may utilize other configurations to engage the fall arrester 10 to such guide rails.

The body 20 of the fall arrester 10 has a slot-shaped opening 29 in which the pawl 18 is mounted on a cylindrical pin 32 to rotate about a first axis 33 (extending perpendicular to the plane of the paper in FIGS. 1-4 and defined by the pin 32) between a disengaged position shown in FIG. 1 and an engaging position shown in FIGS. 2 and 3. The pawl 18 has a tooth 34 that projects from the fall arrester 10 in the engaging position into the inside of the C-profile of the guide rail 12 until it meets one of the catching stops 16 which project inwards from the rear of the rail 12.

In the illustrated embodiments, a damping element 40 is formed as a single, unitary part of a connecting element 41 on the side facing the user. The first connecting element 41 is operably connected to the pawl 18 and configured to transmit force to the pawl from a user attached to the first connecting element 41. In this regard, the first connecting element 41 and has a lug 42 from which a lanyard 43 or other safety harness attachment of the user can be connected to the fall arrester 10, The damping element 40 is U-shaped overall, with the end of one leg of the U terminating at the lug 42 and the end of the other leg extending from the remainder of the first connecting element 41.

The first connecting element 41 is mounted by a cylindrical pin 44 defining a second axis 46 (extending perpendicular to the plane of the paper in FIGS. 1-4) and carried in the pawl 18 and received in a elongate, arcuate slot 48 formed in the connecting element 41 (best seen in FIG. 6); a cylindrical pin 50 defining a third axis 51 (extending perpendicular to the plane of the paper in FIGS. 1-4) and fixed in the body 20 and received in an elongate, longitudinal slot 52 formed in the connecting element 41; and a cylindrical pin 56 defining a fourth axis 58 (extending perpendicular to the plane of the paper in FIGS. 1-4) and fixed in the body 20 and received in an arcuate slot 60 formed in the connecting element 41, This mounting configuration allows the connecting element 41 to translate relative to the slots 48 and 60 and rotate about the axes 33 and 51 in the same direction (clockwise) in response to a first predetermined force being applied in a first direction, as shown by arrow "B" in FIG. 2, and to rotate about the axes 46 and 58 and translate relative to the pins 44 and 50 such that the pawl 18 rotates (clockwise) away from the connecting element 41 in response to a second predetermined force being applied in a second direction, different from the first direction, as shown by Arrow C in FIG. 3. In this regard, the connecting element 41 rotates with the pawl 18 about the first axis 33 between a first position (shown in FIG. 1) of the connecting element 41 wherein the connecting element 41 is engaged against the pawl 18 to transmit a force to the pawl 18 via the pin 44 and respective surfaces 64 and 68 of the pawl 18 and the connecting element 41 that rotates the pawl 18 from the disengaged position shown in FIG. 1 to the engaging position shown in FIG. 2, to a second position of the connecting element 41 (shown in FIG. 2) wherein engagement of the pin 56 against an end of the slot 60 can prevent further rotation of the connecting element 41 in the second position. The above described mounting configuration also allows the connecting element 41 to rotate about the axis 46 and 58 and translate relative to the pins 44 and 50 from the first position to a third position (shown in FIG. 3) in response to the second predetermined force in the second direction while transmitting a rotational force via the pin 44 to the pawl 18 that rotates the pawl 18 from the disengaged position shown in FIG. 1 to the engaging position shown in FIG. 3. It should be understood that an end of the slot 60 engages the pin 56 to limit motion of the connecting element 41 in the first position shown in FIG. 1 and the third position shown in FIG. 3.

While it is believed that the illustrated mounting configuration discussed above for the pawl 18 and the connecting element 41 will be desirable in many applications, in some applications it may be desirable to employ other configurations that allow the pawl 18 and the connecting element 41 to rotate in a common direction as the pawl 18 moves from the disengaged position to the engaged position in response to the first predetermined force applied to the connecting element 41 in the first direction, and for the pawl 18 to rotate away from the connecting element 41 as the pawl 18 moves from the disengaged position to the engaging position in response to the second predetermined force applied to the connecting element 41 in the second direction, and that such alternate configurations would be within the broad scope of this disclosure.

In the illustrated embodiment, a torsion spring 70, best seen in FIG. 1 with one leg 72 engaged with the body 20 and an opposite leg 74 engaged against the connecting element 41, applies a force to the connecting element 41 that is transmitted from the connecting element 41 to the pawl 18 via the pin 44 and the surfaces 64 and 68 to preload the pawl 18 toward the disengaged position shown in FIG. 1. Furthermore, a pair of helical springs 80 are shown, each having one end engaged with a pin in the pawl 18 and opposite end engaged with a pin in the connecting element 41 to preload the pawl 18 and the connecting element 41 against each other.

In the event of a generally downward vertical fall, such as indicated by arrow "B" in FIG. 2, the pawl 18 is pressed into the engaging position shown in FIG. 2 by the downward force of the falling user transmitted to the pawl 18 by the connecting element 41 as the pawl 18 pivots from its disengaged position in FIG. 1 to its engaging position in FIG. 2, with the transmitted falling force being sufficient to overcome the pre-load of the spring 70. In this regard, the falling force is transmitted by engagement of the surface 68 on the connecting element 41 with the surface 64 on the pawl 18. The fall arrest force is conducted to the falling user from the connecting element 41 via a lanyard 90 or other device attached to the lug 42, and the damping element 40 is bent out of its initial U-shape into a largely stretched shape, such as disclosed and shown in U.S. Patent Pub. No. US/2010/0012424 A1. The fall arrest force is thereby damped. However, it should be understood that this disclosure contemplates that a fall arrester 10 according to the disclosure can utilize other forms of a connecting element 41 than the specific form illustrated herein, including forms wherein the connecting element 41 does not include a damping element 40.

In the event that a user should fall in a more horizontally directed direction, such as shown by the arrow "C" in FIG. 3, with the falling force sufficient to overcome the preload of the springs 80, the pawl 18 will again rotate in a clockwise direction about the axis 33, while the connecting element 41 will rotate in a counterclockwise direction about the axis 46 and a clockwise direction about the axis 58 while also translating relative to the pins 44 and 50 with the falling force causing the connecting element 41 to transmit a rotational force via the pin 44 to the pawl 18 that rotates the pawl 18 in the clockwise direction from the disengaged position shown in FIG. 1 to the engaging position shown in FIG. 3. Depending on the force of the fall, the damping element 40 may or may not be bent as described above.

It should be understood that in the event of either of the falls described above in connection with either FIG. 2 or FIG. 3, a significant portion of the falling force is transmitted to the body 20 via engagement of the pins 32 and 50 with the pawl 18 and connecting element 41, respectively.

It should also be understood that while the illustrated embodiments show the axes 33, 46, 51, and 58 extend parallel to each other in a horizontal direction when the fall arrester 10 is in use, this disclosure contemplates that a fall arrester 10 can be configured wherein one or more of the axes 33, 46, 51, and 58 do not extend parallel to each other, or may not extend in the horizontal direction.

While the body 20 can have any suitable construction, in the illustrated embodiment, the body 20 is formed from two elongate frame members 90 and 92 that are essentially mirror images of each other, with the frame members 90 and 92 being held together by a plurality of threaded fasteners 94, and the pins 32, 50, and 56 being fixed on opposite sides to the respective frame members 90 and 92 such that they are supported on both sides.

While the pawl 18 and connecting element 41 can have any suitable construction, in the illustrated embodiment, the pawl 18 includes a centrally located slot 100 having spaced flanges 102 with pin receiving holes 104 formed therein for receiving the pin 44, and the connecting element 41 has a centrally located flange 110 that is received in the slot 100, with the slot 48 formed in the flange 110 so as to receive the pin 44.

While specific embodiments of the fall arrester 10 have been illustrated herein, it should be understood that there are many possible ways to configure a fall arrester 10 within the scope of this disclosure and no limitations to specific illustrated or described embodiments are intended unless the structure for such is expressly recited in the claims.

The present invention can be summarized in the following statements or aspects numbered 1-20:

1. A fall arrester for use in a climbing protection system to protect a user of a ladder, a platform or the like from falls wherein the fall arrester is adapted to be used with, and to be movable along, a guide rail having catching stops engageable by the fall arrester in response to a fall by the user, the fall arrester comprising:

a body configured to be movable along a guide rail;

pawl comprising a pawl tooth, the pawl mounted to the body for movement relative to the body between an engaging position wherein the pawl tooth will engage a catching stop in the guide rail and a disengaged position wherein the pawl tooth will not engage the catching stops in the guide rail;

a connecting element operably connected to the pawl and configured to transmit force to the pawl from a user attached to the connecting element; wherein the pawl and the connecting element are operably connected to each other such that:

(a) the pawl and the connecting element rotate in a common direction as the pawl moves from the disengaged position to the engaged position in response to a first predetermined force applied to the connecting element in a first direction, and (b) the pawl rotates away from the connecting element as the pawl moves from the disengaged position to the engaging position in response to a second predetermined force applied to the connecting element in a second direction that is different than the first direction.

2. The fall arrester in accordance with any one or more of the preceding aspects wherein the pawl is mounted to the body to rotate about a first axis between the disengaged and engaging positions.

3. The fall arrester in accordance with aspect 2 wherein the connecting element rotates about the first axis in the same direction as the pawl in response to the first predetermined force being applied to the connecting element in the first direction.

4. The fall arrester in accordance with aspect 2 wherein the connecting element is mounted to rotate about a second axis spaced from the first axis.

5. The fall arrester in accordance with aspect 4 wherein the first and second axes are parallel to each other.

6. The fall arrester in accordance with aspect 4 wherein first axis is fixed relative to the body.

7. The fall arrester in accordance with aspect 5 wherein the second axis is movable relative to the body.

8. The fall arrester in accordance with aspect 7 wherein the connecting element rotates about the second axis in a direction opposite to the rotation of the pawl about the first axis in response to the second predetermined force being applied to the connecting element in the second direction.

9. The fall arrester in accordance with aspect 4 wherein the second axis moves with the pawl as the pawl rotates about the first axis.

10. The fall arrester in accordance with any one or more of the preceding aspects wherein the pawl is pre-loaded by a spring toward the disengaged position.

11. The fall arrester in accordance with aspect 10 wherein the spring is engaged against the connecting element and the pre-load is transferred to the pawl by engagement of the connecting element against the pawl.

12. The fall arrester in accordance with any one or more of the preceding aspects wherein the connecting element and the pawl are pre-loaded against each other.

13. The fall arrester in accordance with aspect 12 wherein the pre-load is overcome in response to the second predetermined force applied to the connecting element in the second direction.

14. The fall arrester in accordance with aspect 12 wherein the pawl is mounted to the body to rotate about a first axis between the disengaged and the engaging positions, the connecting element is mounted to rotate about a second axis spaced from the first axis, and the pawl rotates about the first axis away from the connecting element in response to the second predetermined force being applied to the connecting element in the second direction.

15. The fall arrester in accordance with aspect 14 wherein the second axis is movable relative to the body and moves with the pawl as the pawl rotates about the first axis.

16. The fall arrester in accordance with any one or more of the preceding aspects wherein the connecting element is formed as a damping element which deforms upon the application of the predetermined force.

17. The fall arrester in accordance with aspect 4 wherein the connecting element is mounted to translate relative to the second axis.

18. The fall arrester in accordance with aspect 9 wherein the connecting element is mounted to translate relative to the second axis.

19. The fall arrester in accordance with aspect 8 wherein the connecting element is mounted to translate about the second axis.

20. The fall arrester in accordance with aspect 15 wherein the connecting element is mounted to translate relative to the second axis.

The invention claimed is:

1. A fall arrester for use in a climbing protection system to protect a user from falls, wherein the fall arrester is adapted to be used with, and to be movable along, a guide rail having catching stops engageable by the fall arrester in response to a fall by the user, the fall arrester comprising:

a body configured to be movable along the guide rail;

a pawl comprising a pawl tooth, the pawl mounted to the body and configured to pivot between an engaging position, wherein the pawl tooth will engage a catching stop in the guide rail to stop the fall by the user, and a disengaged position, wherein the pawl tooth is not engaging any of the catching stops in the guide rail, the pawl being configured to pivot with respect to the body about a first axis;

a connecting element operably connected to the pawl and configured to transmit force to the pawl from a user attached to the connecting element, the connecting element configured to pivot with respect to the body about a second axis which is parallel to the first axis;

wherein the pawl and the connecting element are connected to each other by a spring, the pawl is pre-loaded toward the disengaged position from the spring which provides a pre-load force to the pawl and biasing the pawl into engagement with the connecting element as a result of the pre-load force, the pawl and the connecting element operably connected to each other such that:

(a) the pawl and the connecting element rotate in a common direction as the pawl moves from the disengaged position to the engaging position in response to a first predetermined force applied to the connecting element in a first direction, and (b) the pawl rotates away from the connecting element as the pawl moves from the disengaged position to the engaging position in response to a second predetermined force applied to the connecting element in a second direction that is different than the first direction.

2. The fall arrester of claim 1 wherein the pawl is mounted to the body to rotate about the first axis between the disengaged and engaging positions, and the connecting element rotates about the first axis in a same direction as the pawl in response to the first predetermined force being applied to the connecting element in the first direction.

3. The fall arrester of claim 1 wherein the pawl is mounted to the body to rotate about a first axis between the disengaged and engaging positions, and the connecting element is mounted to rotate about the first axis between the disengaged and engaging position, and the connecting element is mounted to rotate about the second axis spaced from the first axis.

4. The fall arrester of claim 3 wherein the first axis is fixed relative to the body.

5. The fall arrester of claim 3 wherein the second axis is movable relative to the body, and the connecting element rotates about the second axis in a direction opposite to a rotation of the pawl about the first axis in response to the second predetermined force being applied to the connecting element in the second direction.

6. The fall arrester of claim 3 wherein the second axis moves with the pawl as the pawl rotates about the first axis.

7. The fall arrester of claim 1, wherein the pre-load force is configured to be overcome in response to the second predetermined force being applied to the connecting element in the second direction.

8. The fall arrester of claim 1 wherein the second axis is movable relative to the body and moves with the pawl as the pawl rotates about the first axis.

9. The fall arrester of claim 3 wherein the connecting element is mounted to translate relative to the second axis.

10. The fall arrester of claim 6 wherein the connecting element is mounted to translate relative to the second axis.

11. The fall arrester of claim 5 wherein the connecting element is mounted to translate relative the second axis.

12. The fall arrester of claim 8 wherein the connecting element is mounted to translate relative to the second axis.

* * * * *